United States Patent [19]

Davis

[11] Patent Number: 4,970,744

[45] Date of Patent: Nov. 20, 1990

[54] FITTED SHEET

[76] Inventor: Stephen Davis, 711 Lake Harbour #1217, Ridgeland, Miss. 39157

[21] Appl. No.: 517,199

[22] Filed: May 1, 1990

[51] Int. Cl.[5] ..... A47G 9/02

[52] U.S. Cl. ..... 5/496; 5/497

[58] Field of Search ..... 5/494, 496–498; 297/219

[56] References Cited

U.S. PATENT DOCUMENTS

| | | | |
|---|---|---|---|
| 1,322,959 | 11/1919 | Sawasaki | 297/219 X |
| 2,161,448 | 6/1939 | Bishop | 297/219 |
| 2,373,071 | 4/1945 | Waranch | 297/219 X |
| 2,644,962 | 7/1953 | McCrory . | |
| 2,886,833 | 5/1959 | Enger . | |
| 2,931,055 | 4/1960 | Sostrin . | |
| 3,858,256 | 1/1975 | Beer | 5/496 |
| 3,900,909 | 8/1975 | Monier et al. . | |
| 3,906,559 | 9/1975 | Bahr . | |
| 4,192,032 | 3/1980 | Geraci | 5/497 |
| 4,488,323 | 12/1984 | Colburn | 5/460 |
| 4,615,061 | 10/1986 | Scott | 5/497 |
| 4,727,608 | 3/1988 | Joyce | 5/497 |

*Primary Examiner*—Michael F. Trettel

*Attorney, Agent, or Firm*—T. M. Gernstein

[57] ABSTRACT

A fitted sheet includes a hem which completely surrounds the sheet along the perimeter thereof and two drawstrings located in that hem. The drawstrings exit the hem on each side of a transverse centerline of the sheet. Stitching can be included to attach the drawstrings to the sheet.

7 Claims, 1 Drawing Sheet

FITTED SHEET

TECHNICAL FIELD OF THE INVENTION

The present invention relates to the general art of bedding, and to the particular field of sheets.

BACKGROUND OF THE INVENTION

A fitted sheet is often used as a bottom sheet in a bedding set. A fitted sheet generally includes a body having side and end portions which fit around the side and end portions of a mattress so the sheet encases the mattress. The body extends over the top of the mattress and ends of the sheet extend for a short distance along the bottom of the mattress inwardly of the sides and ends of that mattress.

While extremely popular, many fitted sheets have several drawbacks that create problems and inhibit the use of such sheets in some situations, particularly in an institutional situation.

One such problem concerns the neatness of the fit. If the sheet does not snugly engage the mattress, it may become slightly dislodged and loose thereby presenting a sloppy appearance and degrading the overall neatness with which the top sheet, blankets, or other such bedding fit onto the mattress. This is especially true in the case of a convertible bed in which the mattress will be folded and unfolded for storage and use, or in a hospital bed in which a patient may be moving about. Even if a fitted sheet has elastic at the corners thereof, such elastic often becomes loose over time thereby degrading the advantage of such sheet.

Furthermore, most of the presently-available fitted sheets cannot accommodate mattresses having a thickness or shape different from a thickness or shape for which the sheet is designed. Thus, for example, fitted sheets are generally designed to accommodate standard mattresses, however, if a mattress has a non-standard thickness, the sheet may not even fit over that non-standard mattress, or may be so loosely attached to that mattress that it loses nearly all of the advantages generally associated with fitted sheets.

Still further, some fitted sheets shrink during laundering. If the sheet is designed to fit at manufacturing, such shrinking will vitiate the fit; whereas, if the sheet is designed to account for such shrinking, the sheet will probably only fit properly when the designed amount of shrinking has occurred, and not before or after.

Furthermore, the application of a fitted sheet to a mattress and its removal therefrom are arduous tasks for an average housewife, inasmuch as the mattress must be raised at all four corners and warped into or out of the corner pockets of the sheet, as the case may be, depending on whether the bed is being made or unmade. This is an especially onerous task in an institutional setting, such as in a hospital, or in a hotel or motel situation where a great number of beds must be changed rapidly.

Also, ironing and storing such sheets are more difficult than in the case of an ordinary sheet due to the formed corners of such fitted sheets. Again, this makes storing fitted sheets in a house difficult, and extremely problematical in an institutional setting involving numerous sheets.

A standard, non-fitted sheet can accommodate various mattress dimensions as well as shrinkage and can be easily laundered, stored and ironed; however, such sheets have several disadvantages which the fitted sheet is intended to overcome.

Therefore, there is a need for a fitted sheet that combines the advantages of a non-fitted sheet with those of a fitted sheet without the usual disadvantages of a fitted sheet, and can securely accommodate a mattress, especially a mattress having a non-standard thickness or shape, in a secure manner, regardless of the amount of shrinkage associated with the sheet, yet can be easily laundered, stored and applied to the mattress.

OBJECTS OF THE INVENTION

It is a main object of the present invention is to provide a fitted sheet that combines the advantages of a non-fitted sheet with those of a fitted sheet without the usual disadvantages of a fitted sheet.

It is another object of the present invention to provide a fitted sheet that combines the advantages of a non-fitted sheet with those of a fitted sheet without the usual disadvantages of a fitted sheet, and can securely accommodate a mattress.

It is another object of the present invention to provide a fitted sheet that combines the advantages of a non-fitted sheet with those of a fitted sheet without the usual disadvantages of a fitted sheet, and can securely accommodate a mattress, especially a mattress having a non-standard thickness or shape.

It is another object of the present invention to provide a fitted sheet that combines the advantages of a non-fitted sheet with those of a fitted sheet without the usual disadvantages of a fitted sheet, and can securely accommodate a mattress, especially a mattress having a non-standard thickness, in a secure manner, regardless of the amount of shrinkage associated with the sheet.

It is another object of the present invention to provide a fitted sheet that combines the advantages of a non-fitted sheet with those of a fitted sheet without the usual disadvantages of a fitted sheet, and can securely accommodate a mattress, especially a mattress having a non-standard thickness, in a secure manner, regardless of the amount of shrinkage associated with the sheet, yet can be easily laundered, stored and applied to the mattress.

SUMMARY OF THE INVENTION

These, and other, objects are achieved by a fitted sheet having two drawstrings positioned in a hem which is located completely around the periphery of the sheet, with each drawstring having the ends thereof extending out of the hem immediately adjacent to the transverse centerline of the sheet.

The drawstrings each pull one half of the sheet toward the center of that sheet and, being located at the transverse center of the sheet, are easily accessible. Furthermore, by being located so the knot used to tie the drawstrings together is on the transverse centerline of the sheet, the drawstring knot produces excellent and efficient size controlling features for the sheet whereby a large variation in mattress thickness dimension and/or shape can be accommodated by the sheet.

Since the size of the sheet can be varied by means of the drawstrings, size variation in the sheet can be easily accounted for. Therefore, the sheet need not be designed for shrinkage and will securely fit a mattress whether or not the sheet shrinks during its lifetime.

Furthermore, since the sheet includes a drawstring, it can be flattened out to a much greater degree than prior fitted sheets. This feature makes laundering, storage and application to a mattress extremely easy and expeditious as compared to prior fitted sheets.

By having two tie positions, each located on the same centerline of the sheet, the minimum number of operations are required to effect a neat, secure fit of the sheet without creating a possibility of a non-secure fit at one or more locations or without requiring undue pressure to be applied to each tie location.

In this manner, a single sheet can fit snugly onto a wide variety of mattresses, yet still do so in a manner which is not likely to let the sheet slip out of a desired position on the mattress regardless of whether or not the sheet shrinks during laundering.

BRIEF DESCRIPTION OF THE DRAWING FIGURES

DETAILED DESCRIPTION OF THE PREFERRED EMBODIMENT OF THE INVENTION

Figure 1:
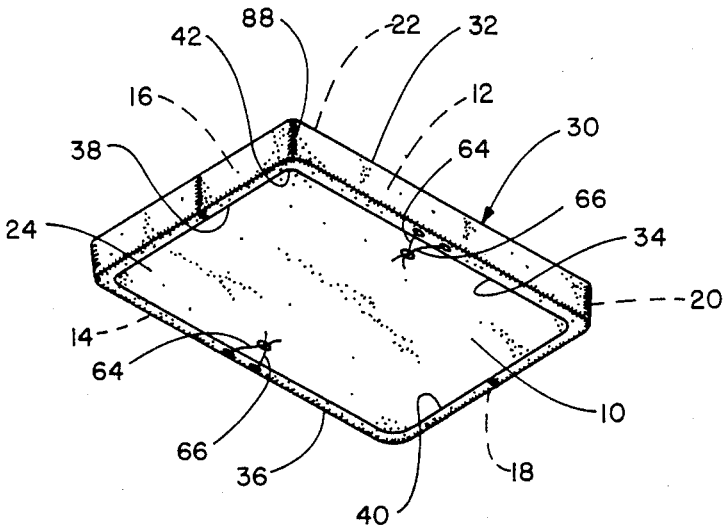
FIG. 1 is a bottom perspective view of a mattress having the fitted sheet of the present invention in place thereon.

Shown in FIG. 1 is a mattress 10 having sides 12 and 14, and ends 16 and 18 which intersect each other at corners, such as corner 20. The mattress has a top surface 22 and a bottom surface 24 separated by a thickness dimension of the mattress. The top and bottom surfaces are taken with reference to an in-use orientation of the mattress, and the mattress is polygonal in shape, with various sizes for queen, king, double or the like beds. Other sizes and shapes can also be used without departing from the scope of this disclosure.

Figure 2:
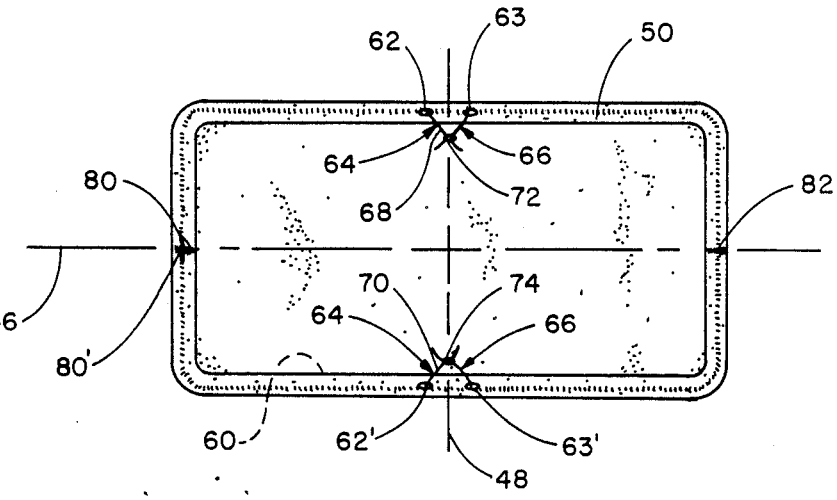
FIG. 2 is a bottom plan view of the mattress shown in FIG. 1.

The mattress 10 is shown in FIGS. 1 and 2 to be covered by a fitted sheet 30 embodying the present invention. The fitted sheet 30 includes a monolithic body 32 having sides 34 and 36, and ends 38 and 40 that are located adjacent to and inwardly of the sides and ends of the mattress when the sheet is in place on that mattress. The body of the sheet covers the top surface of the mattress and the ends and sides of the sheet cover the ends and sides of the mattress when the mattress is in place, and the monolithic nature thereof prevents the sheet from being torn during use. As will be understood from the ensuing discussion, the sheet will be pulled into position beneath a mattress, and thus may have some parts thereof subjected to fairly high stresses. The monolithic nature of the sheet resists such stresses.

The sides and ends of the sheet intersect each other at sheet corners, such as sheet corner 42, which are located adjacent to and inwardly of the mattress corners when the sheet is in place. The preferred form of the sheet is polygonal, specifically square, and the sheet has a length dimension measured between the ends thereof and a width dimension as measured between the sides thereof. The sheet has a longitudinal centerline 46 extending from one end of the sheet to the other, and a transverse centerline 48 extending along the width dimension thereof.

It is noted that the sheet 30 has no elastic members so its shape can be nearly planar when it is not mounted on the mattress. This will facilitate laundering and storing the sheet.

The sheet is mounted on a mattress by a tie means which includes a continuous, unbroken hem 50 which completely circumnavigates the outer periphery of the sheet and extends along each of the sides and ends for the entire length of each side and end. The hem is formed by doubling the sheet over adjacent to each side and end to form a two ply portion of the sheet, and attaching the sheet end and side to the sheet body adjacent to the doubled over sheet end and side. The hem thus includes a top ply 56 and a bottom ply 58. Stitching 52, or the like, is used to attach the sheet end or side to the sheet body. The hem forms a hollow chamber 60 which extends completely around the periphery of the sheet in an uninterrupted manner.

Figure 3:
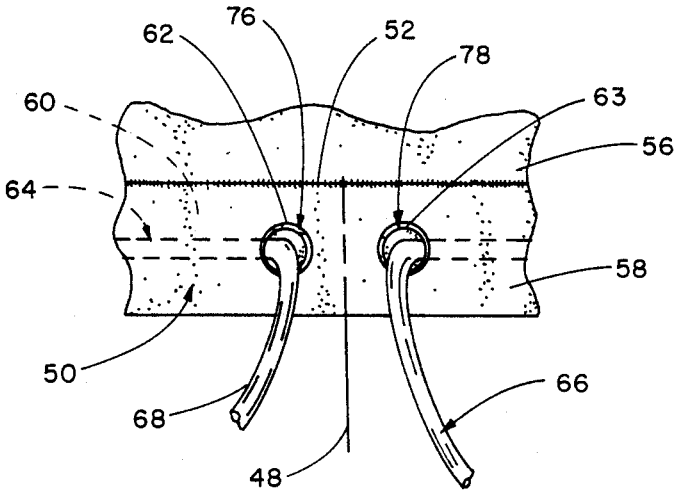
FIG. 3 is a blow up of one portion of the sheet showing the eye openings into a hem of the sheet and drawstrings exiting the hem via the eye openings.

As shown in FIGS. 1, 2 and 3, two pairs of openings, such as opening 62, are defined through the hem top ply 58 adjacent to the sheet sides. Each of the openings is located immediately adjacent to the transverse centerline 48, and each pair of openings has one opening on each side of the transverse centerline. The openings are separated along the width dimension of the mattress as shown in FIGS. 1 and 2. As shown in FIG. 2, the openings on one side of the sheet correspond to the openings on the other side of the sheet. Thus, opening 62 on one side of the sheet has a corresponding opening 62' in the other pair of openings on the other side of the sheet, and opening 63 adjacent to opening 62 has a corresponding opening 63' in the other pair of openings on the other side of the sheet. The corresponding openings are on the same side of the transverse centerline, so that, for example, openings 62 and 62' are on the same side of the transverse centerline; whereas openings 63 and 63' are on the same side of the transverse centerline with each other and on the opposite side of the transverse centerline from the openings 62 and 62'.

Two identical monolithic drawstrings 64 and 66 are positioned inside of the hem chamber 60. Each of the drawstrings has one end, such as end 68 of drawstring 64, extending out of the hem chamber via one of the openings in one of the pairs of openings, and a second end, such as end 70 of the drawstring 64, extending out of the hem chamber via a corresponding opening in the other pair of openings located on the other side of the sheet. Thus, drawstring 64 has end 68 extending out of the hem chamber via the hole 62 and the other end 70 thereof extending out of the chamber via hole 62'; whereas drawstring 66 extends out of the hem chamber via the corresponding openings 63 and 63' of the first and second pairs of openings on either side of the sheet. Each drawstring thus crosses the longitudinal centerline, but not the transverse centerline.

Each drawstring thus extends along approximately one half of the perimeter of the sheet from one side of the sheet to the other, and therefore will control and size one half of the sheet when one end thereof is pulled against the other end.

The sheet is easily placed on a mattress in the manner of a flat sheet, and the drawstrings are tied together at one side of the sheet. The drawstrings are long enough to permit positioning of the sheet in the manner of a flat, non-fitted sheet on the mattress. The drawstrings on the other side of the sheet are then pulled toward each other and tied together. This pulls the sheet sides toward each other and pulls the sheet ends toward each other. The sheet will move itself under the mattress in the proper position to snugly encase that mattress. The mattress need not be moved, as the sheet will position itself.

For example, the sheet is merely placed on top of a mattress with the sides and ends thereof adjacent to the sides and ends of the mattress. End 68 of drawstring 64 is then tied to the adjacent end of drawstring 66 to form a knot, such as knot 72 adjacent to the holes 62 and 63. The opposite end 70 of drawstring 64 is pulled toward the adjacent end of drawstring 66 and is knotted thereto to form a knot 74. Pulling the drawstrings toward each other tightens the sheet about and beneath the mattress, and the sheet automatically moves into a snug fit about the mattress. As shown in FIG. 2, the knots are positioned on the transverse centerline of the sheet and thus pressure on the drawstrings will be evenly applied to all portions of the sheet. This will prevent puckering or the like as the sheet is being positioned about the mattress.

Eyelet coverings 76 and 78 are included adjacent to each of the openings 62, 62', 63 and 63' to prevent the sheet from tearing during use of the drawstrings.

As is shown in FIG. 2, the sheet also can include reinforcing stitching portions 80 and 82 that extend along the longitudinal centerline 46 from an end for a short distance toward the transverse centerline of the sheet. The stitching portions 80 and 82 can attach each drawstring 64 and 66, respectively, to the sheet at the middle of such drawstrings. This stitching prevents the drawstrings from falling out of the hem chamber during laundering or the like. The location of the stitching portions 80 and 82 on the longitudinal centerline divides the sheet exactly in half so that each drawstring still pulls only one half of the sheet as that drawstring is being pulled toward the other drawstring to form the knots 72 and 74 as above discussed. This enables such sheet-attached drawstrings to control the sheet in the manner discussed above so as to prevent puckering or the like as the sheet is being pulled onto the mattress and into position beneath the mattress in a mattress-enveloping configuration and position. In the preferred embodiment, the stitching 80 is approximately one inch long. It is also noted that the stitching 80 can extend transversely of the sheet along the length dimension of the drawstring, as is indicated in FIG. 2 at stitching 80'.

The sheet is polygonal, but can accommodate any shaped mattress due to the just-described action of the sheet as it is being tightened to the mattress. Even though the sheet is polygonal, it will adapt the shape of the mattress, even if that mattress is circular in shape.

Corner stitching, such as corner stitching 88 can be included if suitable. However, such corner stitching is not necessary to the full and proper functioning of the sheet since the action of the drawstrings ensures proper fits between the corners of the mattress and the sheet.

It is understood that while certain forms of the present invention have been illustrated and described herein, it is not to be limited to the specific forms or arrangements of parts described and shown.

I claim:

1. A fitted sheet comprising:

(a) a monolithic polygonal body having two ends and two sides with said ends and sides intersecting to form corners of said body, said body having a length dimension defined between said body ends, a width dimension defined between said sides, a longitudinal centerline extending from one end to the other end midway between said sides, and a transverse centerline extending between said sides midway between said ends;

(b) tie means on said body and including (1) a continuous, unbroken hem defined on said body adjacent to said body ends and sides and extending completely around the entire perimeter of said body, said hem including a top ply attached to said body adjacent to said sides and ends, said top ply and said body adjacent to said top ply forming a hollow hem chamber which extends completely and continuously in an unbroken manner around the entire periphery of said body, (2) two first openings defined through said hem top ply to open into said hem chamber, said first openings being located adjacent to one of said body sides and immediately adjacent to and on either side of said body transverse centerline, (3) two second openings defined through said hem top ply to open into said hem chamber, said second openings being located adjacent to the other side of said body two sides and immediately adjacent to and on either side of said body transverse centerline, (4) said first openings being spaced from said second openings along said body width dimension, (5) two monolithic drawstrings positioned inside of said hem hollow chamber and each having one end portion extending out of one opening of said first openings and another end portion extending out of a corresponding opening of said second openings.

2. The fitted sheet defined in claim 1 wherein said one opening of said first openings and said corresponding opening of said second openings are on the same side of said transverse centerline.

3. The fitted sheet defined in claim 2 wherein each of said monolithic drawstrings extends across said longitudinal centerline and does not cross said transverse centerline.

4. The fitted sheet defined in claim 3 further including two reinforcing stitching portions, each reinforcing stitching portion extending along said body longitudinal centerline from one end for a short distance and each coupling one of said drawstrings to said body.

5. The fitted sheet defined in claim 4 further including an eyelet ring attached to said sheet body adjacent to each opening.

6. The fitted sheet defined in claim 5 further including stitching means on each corner of said body for reinforcing said body.

7. The fitted sheet defined in claim 6 wherein said polygonal body is rectangular.

* * * * *